US005639125A

United States Patent [19]

Garrison

[11] Patent Number: 5,639,125

[45] Date of Patent: Jun. 17, 1997

[54] PRESSURE SENSITIVE LABEL ASSEMBLY

[75] Inventor: Ronald R. Garrison, Batavia, Ill.

[73] Assignee: Wallace Computer Services, Inc., Hillside, Ill.

[21] Appl. No.: 370,297

[22] Filed: Jan. 6, 1995

[51] Int. Cl.[6] ..... B42D 15/10

[52] U.S. Cl. ..... 283/81; 283/101; 283/107; 283/109

[58] Field of Search ..... 283/81, 101, 109, 283/107, 61, 62, 904; 428/204, 916

[56] References Cited

U.S. PATENT DOCUMENTS

| | | | |
|---|---|---|---|
| 2,648,924 | 8/1953 | Brewster . | |
| 3,466,218 | 9/1969 | Avery . | |
| 3,854,229 | 12/1974 | Morgan | 283/81 X |
| 4,204,706 | 5/1980 | Blum et al. . | |
| 4,526,405 | 7/1985 | Hattemer . | |
| 4,544,590 | 10/1985 | Egan . | |
| 4,664,416 | 5/1987 | Steidinger . | |
| 4,747,619 | 5/1988 | Sager . | |
| 4,911,477 | 3/1990 | Shishido | 293/81 X |
| 4,951,970 | 8/1990 | Burt | 283/81 X |
| 5,173,081 | 12/1992 | Greig . | |
| 5,284,363 | 2/1994 | Gartner et al. | 283/81 |
| 5,362,106 | 11/1994 | Longtin | 283/109 |

*Primary Examiner*—Frances Han

*Attorney, Agent, or Firm*—Roylance, Abrams, Berdo & Goodman

[57] ABSTRACT

A label assembly includes a label having pre-printed indicia or a printable face on an information side and a pressure sensitive adhesive on a back side. The label is releasably adhered to a front side of a transparent sheet. The transparent sheet includes a pressure sensitive adhesive on a back side thereof releasably adhered to a carrier sheet. The label assembly includes a label that can be printed by the ultimate user. The label can then be removed from the transparent sheet and applied to an article. The transparent sheet can then be removed from the backing sheet and applied over the label to provide a protective cover for the label.

32 Claims, 4 Drawing Sheets

PRESSURE SENSITIVE LABEL ASSEMBLY

FIELD OF THE INVENTION

The present invention is directed to a label assembly that includes a pressure sensitive label and a transparent cover sheet. More particularly, the invention relates to an assembly including a removable label and a removable transparent sheet for applying over the label as a laminate.

BACKGROUND OF THE INVENTION

Pressure sensitive labels are well known and have been used for a number of years. The labels are typically produced with a removable backing sheet such that the labels are removed from the backing sheet and applied to an article. In many instances, the labels are pre-printed with the desired information. Other labels are produced with a writing surface so that the desired information can be applied to the label before or after applying the label to a mounting surface.

In many instances, it is desirable to apply desired information on a label and cover the label with a transparent film to protect the label from moisture. A transparent film applied over a label is also desirable to protect the label and the information from abrasion or smearing. Numerous label systems have been proposed to include a transparent film that can be applied over a label. Examples of this type of label system are disclosed in U.S. Pat. Nos. 4,204,706 to Blum et al, 4,747,619 to Sager, 4,544,590 to Egan and 5,083,979 to Burt.

The above-noted label systems are not entirely satisfactory for many labelling processes. Some of the previous label systems require multiple steps to print the desired information on the label and to apply the transparent film. Other label systems utilize pressure sensitive marking inks which require the application of pressure or an impact-type printer to effectively mark the label. This form of label typically cannot be printed using an ink jet or laser printer. Another form of labelling system requires separation of various layers before the label can be printed.

One type of label disclosed in U.S. Pat. No. 5,083,979 to Burt et al includes a clear film positioned next to the label on a carrier sheet. This arrangement has the disadvantage in that a large surface area of the label form is occupied by the clear film thereby limiting the size and the amount of information that can be printed on the label. This arrangement also requires a carrier sheet essentially twice the size of the label. This results in increased manufacturing costs and excessive waste. Accordingly, there is a continuing need in the industry for a pressure sensitive label that can be printed by a variety of printing methods and is easy and convenient to use.

SUMMARY OF THE INVENTION

A label assembly has been developed having a printing face that can be used for labelling envelopes, packages, containers and the like. The label assembly comprises a label having an information side and a pressure sensitive adhesive on a second side thereof, a transparent sheet coextensive with the label and having a front side releasably adhered to the second side of the label, and an adhesive on a second side of the transparent sheet for permanently bonding the transparent sheet to the information side of the label. By providing the label assembly in this fashion, suitable indicia can be applied to the information side of the label without the need to disassemble the assembly. The assembly can then be removed from the label and applied to the end product or article by the pressure sensitive adhesive. The transparent sheet is then applied over the label to provide a protective cover or laminate over the label. The transparent sheet provides a weatherproof label to protect the information printed on the label.

The label assembly of the present invention is a multi-ply, unitary assembly thereby eliminating extraneous support layers and release sheets. The assembly is easy and inexpensive to manufacture using conventional manufacturing equipment. Furthermore, the label assembly includes a printable label which can cover substantially the entire surface area of the assembly, thereby maximizing the available area for printing or applying variable information. The assembly being a single unit can be passed through a variety of printing devices without premature separation of the layers.

According to one embodiment of the invention, the information surface of the label includes pre-printed indicia, such as a blank form. The ultimate user can insert the necessary information on the label using a pen, pencil, typewriter or other printer. The label is then separated from the assembly and adhered to the intended article. Thereafter, the transparent sheet is applied over the label to protect the label from moisture, abrasion and tampering. In embodiments of the invention, the transparent sheet is a plastic film material that does not easily accept ink so that it is difficult to write on the surface of the transparent sheet. A non-printable surface on the transparent sheet prevents alteration of the label after the transparent sheet is applied to the label. The pressure sensitive adhesive on the transparent sheet is sufficiently tacky to permanently adhere to the information side of the label such that the transparent sheet cannot be removed without destroying the label.

According to another embodiment of the present invention, the transparent sheet includes a release coating on the front face thereof to assist in the easy separation of the label from the assembly. The release coating also provides a non-writable surface on the transparent sheet.

According to a further embodiment of the present invention, a carrier sheet having a release coating on one side thereof supports one or more of the label assemblies. The carrier sheet may be a continuous roll having a plurality of the label assemblies releasably adhered thereon by the pressure sensitive adhesive on the transparent sheet. Alternatively, the carrier sheet can be a dimensioned sheet supporting a single transparent sheet and label. During use, the transparent sheet can be removed from the carrier sheet and applied to the label as discussed above.

According to another embodiment of the present invention, the label assembly is removably adhered to a business form within a designated area. The business form and the label can be completed in the normal course of business by a variety of printers, including computer-controlled printers. The label containing the desired information is then removed and applied to the desired article such as an envelope or container. The transparent sheet is removed and adhered to the label. In preferred embodiments, the label assembly may include a carrier sheet having an upper side with a release layer releasably adhered to the transparent sheet and a back side adhered to the business form. Alternatively, the business form can have a designated area including a release coating to enable easy separation of the transparent sheet from the form.

In a further aspect of the invention, a method of labelling an article comprises providing a label assembly having a label with an information surface and a back side having a pressure sensitive adhesive, a transparent sheet having a first side releasably adhered to the back side of the label and a second side having a pressure sensitive adhesive, and a removable carrier backing sheet releasably adhered to the transparent sheet, the method comprising removing the label from the assembly and adhering the label to the article, and removing the transparent sheet from the backing sheet and applying it to the label.

Other objects, advantages and salient features of the present invention will become apparent from the following detailed description, which, taken in conjunction with the annexed drawings, discloses preferred embodiments of the invention.

BRIEF DESCRIPTION OF THE DRAWINGS

Referring now to the drawings which form a part of this original disclosure.

DETAILED DESCRIPTION OF THE INVENTION

The present invention is directed to multi-ply label assemblies as shown in FIGS. 1–6. In particular, a label assembly 10 is provided for applying a label to a desired article along with a transparent outer protective film.

Figure 1:
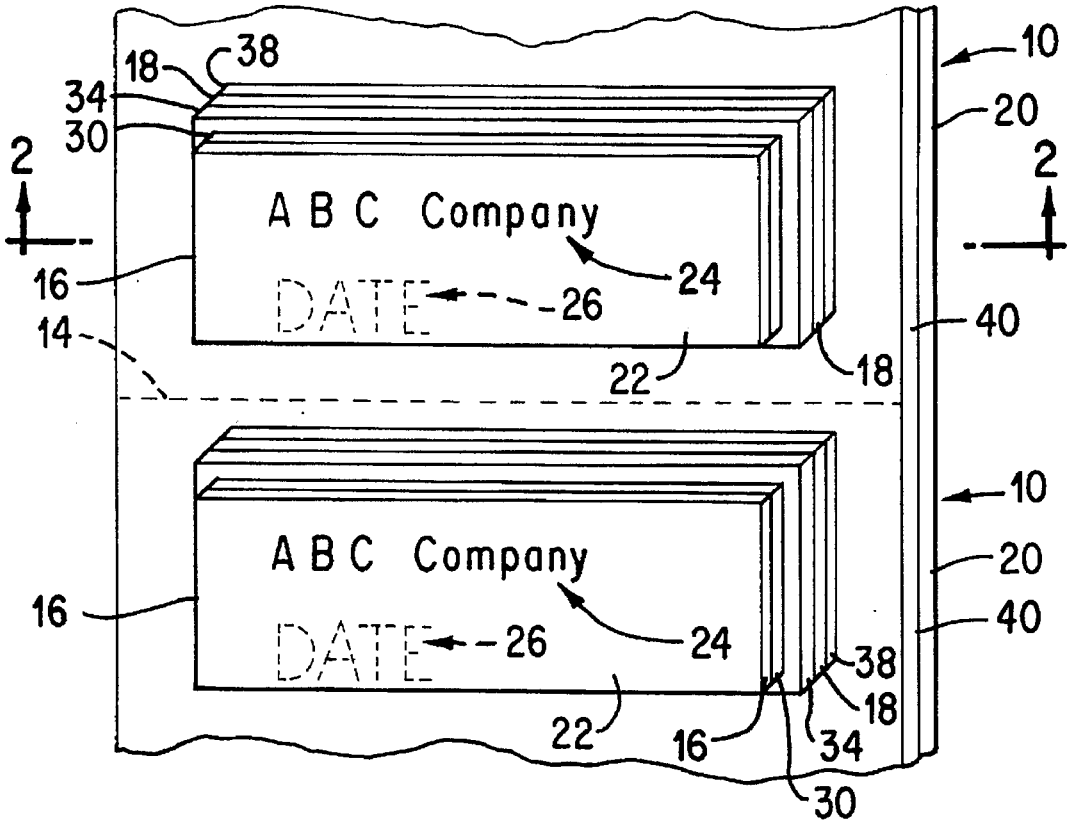
FIG. 1 is a perspective view of the label assembly in accordance with a first embodiment of the invention showing the label assembly on a continuous carrier sheet.
Figure 2:
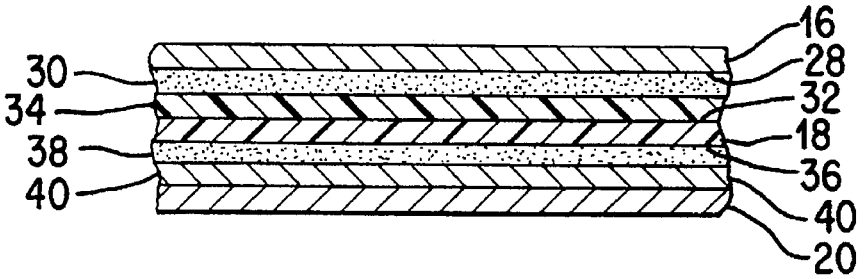
FIG. 2 is a partial cross-sectional view of the label assembly taken along line 2—2 of FIG. 1.

Referring to FIGS. 1 and 2, a first embodiment of the label assembly 10 is illustrated. In this embodiment of the invention, a plurality of label assemblies 10 are formed as a continuous sheet separated by frangible lines 14. Typically, the frangible lines 14 are perforations allowing easy separation of assemblies 10. Label assembly 10 includes a label 16, a transparent sheet 18 and a carrier sheet 20. Label 16, transparent sheet 18 and carrier sheet 20 are produced having a standard thickness as used in the label manufacturing field. The layers are shown in the Figures having exaggerated thicknesses for purposes of illustration. The various layers may be, for example, about 1–4 mil thick.

In further embodiments, the label assemblies 10 are manufactured using a continuous carrier sheet without frangible lines between the assemblies. Alternatively, the label assemblies can be separated by cutting the carrier sheet into distinct sheets.

Label 16 is preferably made of paper, such as kraft paper, although other suitable label materials may be used. Label 16 includes an information surface 22 for receiving printed indicia 24. In the embodiment shown in FIG. 1, printed indicia 24 identifies the company name. However, in practice, any desired printed indicia may be applied. In preferred embodiments, information surface 22 of label 16 includes a space for receiving variable information 26. Information surface 22 is preferably a writable surface, whereby variable information 26 can be applied by a suitable writing tool such as a pen, pencil, typewriter or computer-controlled printing apparatus. The rear face 28 of label 16 includes a pressure sensitive adhesive 30 releasably adhered to transparent sheet 18.

As used herein, "label" is intended to refer to a substrate having a writing surface for receiving variable information. The label can be in the form of an address label, packing slip or a label for identifying an article, the contents of a container, dates, catalog number and the like. The label may include pre-printed indicia to reflect the intended final use of the label. Alternatively, the label may be manufactured as a blank form which can be completed by the ultimate user or customer.

The pressure sensitive adhesives used in accordance with the present invention are transparent tacky adhesives commonly used on the label manufacturing field. Examples of adhesives are: acrylic types, such as those made from polyacrylic or methacrylic esters or acids, polyvinyl ethers, copolymers of vinyl ethers and acrylics; rubber based adhesives, such as those based on polyisobutylene, polycloroprene, polybutadiene, copolymers of styrene with butadiene and isoprene and latex variations on styrene, butadiene and isoprene; and adhesives based on silicone rubber such as polysiloxane methacrylate. One type of pressure sensitive adhesive is made by Technicote of Cuyahoga Falls, Ohio. The pressure sensitive adhesive may be of the hot melt type or the solvent type. The type of adhesive used will depend on the intended use of the label and the manufacturing process. A hot melt adhesive only requires the adhesive to cool before applying it to a surface, while solvent types require evaporation of the solvent before a subsequent process step can be carried out.

In the embodiments of the invention, as shown in FIG. 1, the pressure sensitive adhesive 30 is applied to coat the entire rear face 28 of label 16. In further embodiments, pressure sensitive adhesive is applied so as not to extend along one edge of label 16, thereby providing an edge which can be easily gripped by the user for easy separation of layers as discussed hereinafter in greater detail. In still further embodiments, the pressure sensitive adhesive is applied in a localized area, such as a band around the perimeter of the label, depending on the particular needs and intended use of the label.

Transparent sheet 18 is a flexible plastic material such as polyethylene, polyester, ethylene vinyl acetate, polyethylene terephthalate, cellophane, cellulose nitrate, cellulose acetate, ethyl cellulose and copolymers of methyl methacrylate. In preferred embodiments, sheet 18 is sufficiently transparent to easily view indicia on label 16 when sheet 18 is applied over label 16. The transparent sheet preferably has a thickness to provide the necessary strength to be peeled from the carrier sheet without tearing and to adequately protect the label in its laminated form. The thickness of the transparent sheet may be, for example, about ½ mil to about 4 mil, depending on the material used and the intended environment of the label. The transparent sheet may optionally include a color tinting or printed indicia such as a logo. In further embodiments, sheet 18 may be translucent such that indicia 24 on label 16 can be easily viewed by the user.

In the embodiment shown in FIG. 1, transparent sheet 18 includes a front side 32 having a layer of an adhesive release material 34. Release material 34 may be a standard silicone release material or wax material typically used in the adhesive industry. In embodiments of the invention, the transparent sheet may have sufficient release qualities for an adhesive that a separate release layer may be unnecessary. Typically, the release layer and carrier comprise a silicone treated film.

Back side 36 of transparent sheet 18 includes a pressure sensitive adhesive layer 38. Pressure sensitive layer 38 may be the same or different from adhesive 28 and preferably covers the entire back side of transparent sheet 18. In alternative embodiments, the pressure sensitive adhesive may be applied to a localized area. For example, the pressure sensitive adhesive can be applied only around the perimeter of the transparent sheet such that when the transparent sheet is placed over the label, the adhesive surrounds the label to provide a protective seal.

Carrier sheet 20 is generally made of a paper material such as kraft paper, although other materials may be used. A release layer 40 is provided on the front face of carrier sheet 20. Typically, release layer 40 is the same as release layer 30, but may be different depending on the particular requirements of the adhesive and the carrier sheet. Release layer 40 and carrier sheet 20 are typically a silicone treated paper.

The label assembly 10 is manufactured using standard laminating and label manufacturing equipment. In one embodiment the label in the form of a continuous web may be unwound from a supply roll. The web passes through a printing apparatus to apply the desired indicia on the front side, while a pressure sensitive adhesive is applied to the back side by spraying, rolling or other suitable adhesive application method. The web is then laminated onto a web of transparent sheet material having a release coating on a front side and a pressure sensitive adhesive on the back side. The resulting laminate may be die cut into individual labels and laminated onto a continuous carrier sheet. Alternatively, the laminate can be further laminated onto a continuous carrier sheet and then cut into individual label assemblies.

In the embodiment of FIGS. 1 and 2, label assembly 10 comprises labels 16 and transparent sheets 18 which are die cut to the desired size and laminated onto continuous carrier sheet 20. In further embodiments, labels 16 and transparent sheets 18 may be substantially the same width as carrier sheet 20. Label 16 is releasably adhered to transparent sheet 18 by pressure sensitive adhesive 30 on label 16 and release layer 34 on transparent sheet 18. Transparent sheet 18 is in turn releasably adhered to carrier sheet 20 by pressure sensitive adhesive 36 on transparent sheet 18 and release layer 40 on carrier sheet 20. The result is label assembly 10 being a multiply unitary assembly with no loose sheets or layers.

As a unitary member, label assembly 10 has the advantage that the various sheets cannot be inadvertently separated. The necessary variable information can be applied to information face 22 by manually writing or printing after the assembly is manufactured. The variable information can be applied by the ultimate user without disassembling the label. The label assembly 10 is particularly advantageous in that the assembly can pass through computer-operated printing means such as a laser printer without premature separation of the layers. The pressure sensitive adhesive layers are protected from dirt, moisture, solvents and the like until peeled from the respective layer.

By way of example, label assembly 10 may be used as an address label or as an information sheet for identifying the contents of a container. For example, label assembly 10 may be used to identify a test sample such that the variable information may include items such as sample number, source, date and other identification. Label 16 is then peeled from transparent sheet 18 and adhered to the sample container. Thereafter, transparent sheet 18 is peeled from carrier sheet 20 and applied directly over label 16. Transparent sheet 18 being laminated to label 16 by pressure sensitive adhesive 36 is permanently adhered such that transparent sheet 18 cannot be removed without damaging label 16. Transparent sheet 18 provides a tamper evident outer face, as well as a protective face protecting label 16 from moisture, abrasion and the like. The pressure sensitive adhesive is selected to adhere to the back of the label and the transparent sheet and be releasable from the release layers. The pressure sensitive adhesive, furthermore, permanently adheres the label to the intended article and permanently adheres the transparent sheet to the label.

In embodiments of the invention, as shown in FIG. 1, transparent sheet 18 is slightly larger than label 16. In this manner, transparent sheet 18 will slightly overlap label 16 when laminated thereon. Carrier sheet 20 may be dimensioned substantially the same size as transparent sheet 18 or may be slightly larger to define a free edge for assisting in the separation of the layers at the desired time. In further embodiments of the invention, the label and the transparent sheet may be substantially the same size. In a similar manner, pressure sensitive adhesive 28 on label 16 and pressure sensitive adhesive 36 on transparent sheet 18 may extend only over a portion of the respective sheet to define an edge free of adhesive to assist in separation of the layers.

Figure 3:
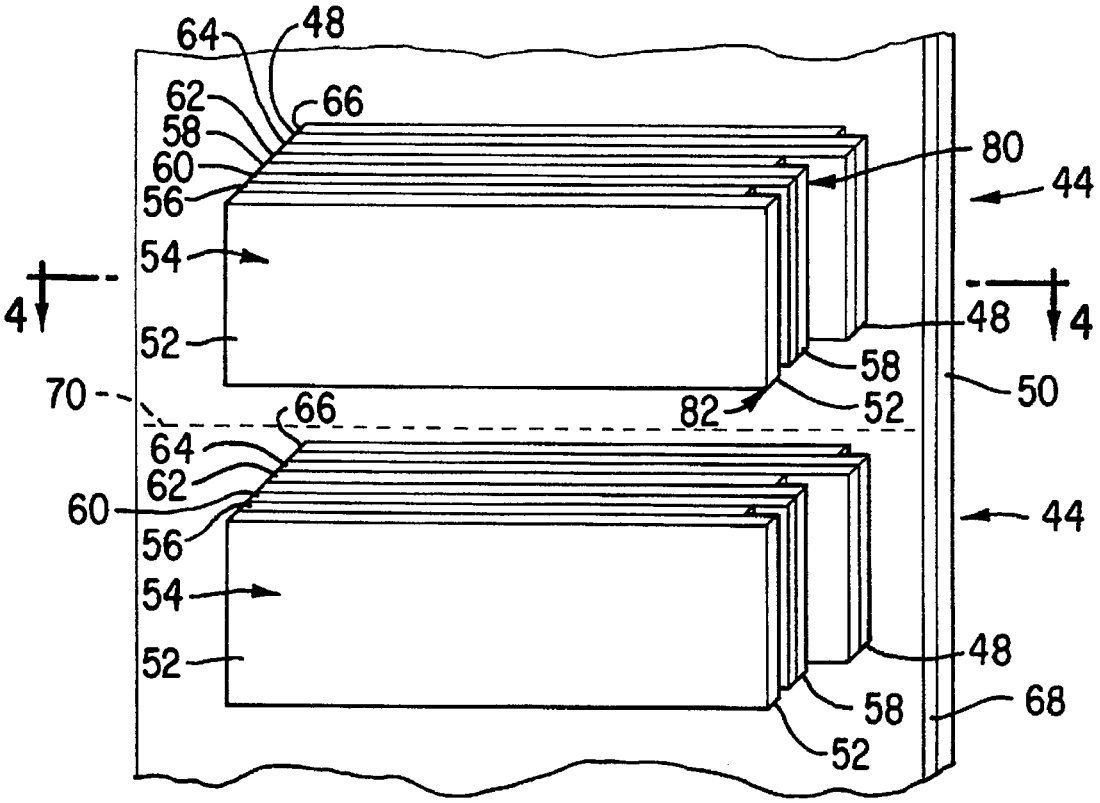
FIG. 3 is a perspective view of the label assembly in accordance with a second embodiment of the invention.
Figure 4:
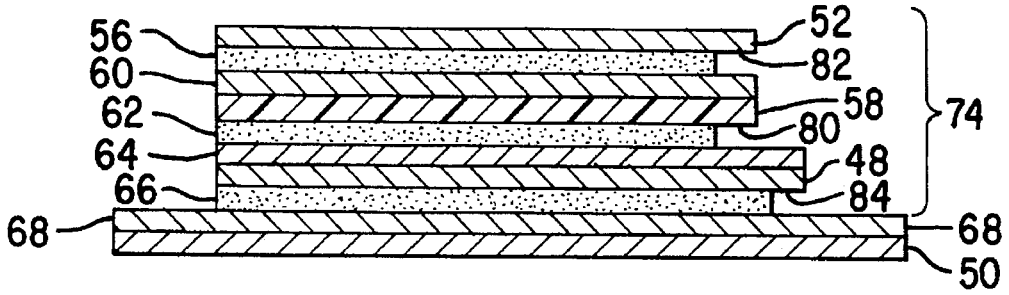
FIG. 4 is a cross-sectional view of the label assembly taken along line 4—4 of FIG. 3.
Figure 5:
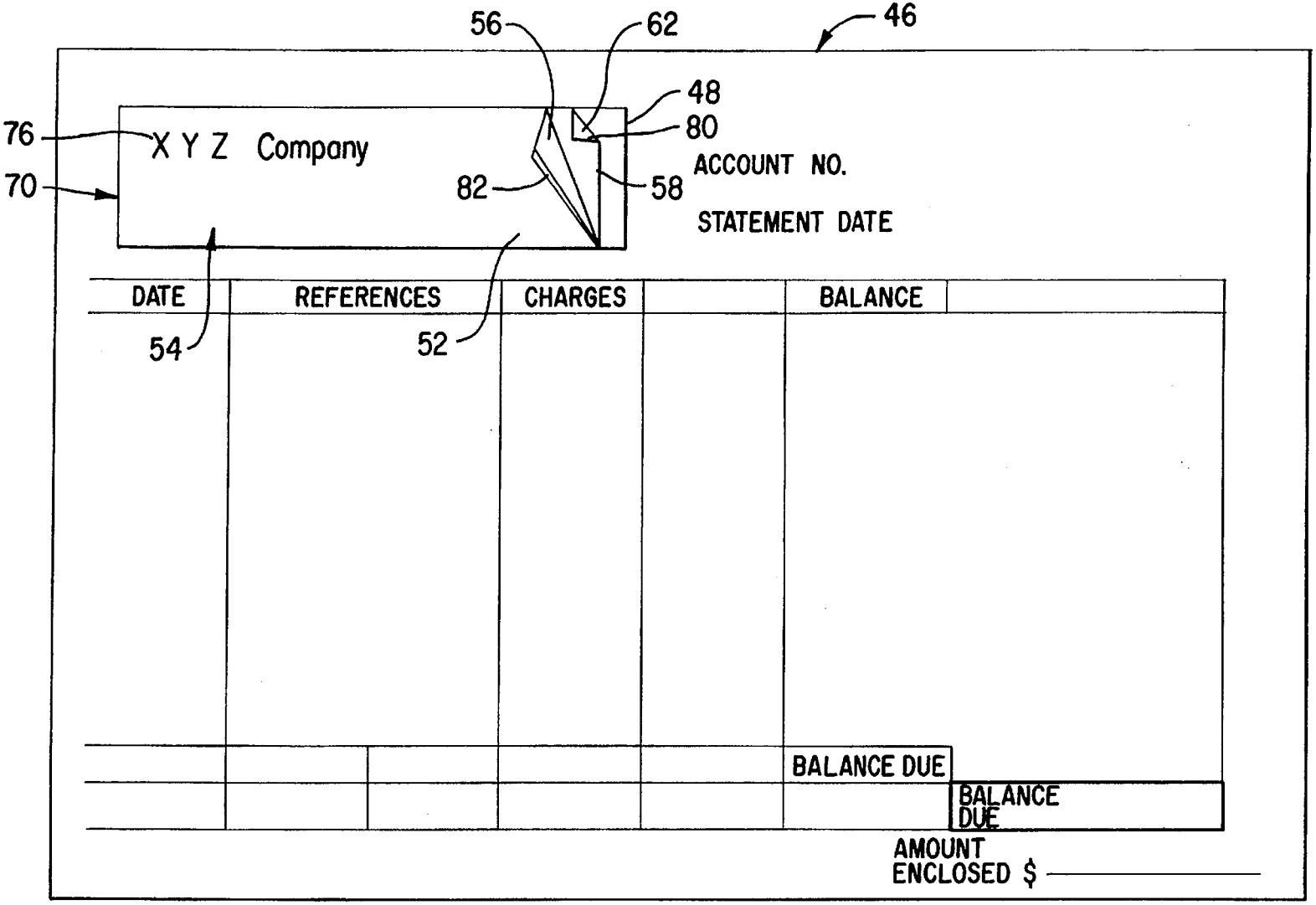
FIG. 5 is a perspective view of a further embodiment of the invention showing the label assembly in conjunction with a business form.

In a further embodiment of the invention shown in FIGS. 3 and 4, label assembly 44 is used in producing a business form 46, as shown in FIG. 5. Label assembly 44 is similar to label assembly 10 with the exception of an additional carrier sheet 50.

Label assembly 44 comprises a label 52 having an information surface 54 and a pressure sensitive adhesive layer 56 on a back side thereof. Label 52 is releasably adhered to transparent sheet 58. Transparent sheet 58 includes a front side with a release layer 60 and back side with a pressure sensitive adhesive 62. Transparent sheet 58 is releasably adhered to first carrier sheet 48 by pressure sensitive adhesive 62. First carrier sheet 48 includes a front side with a release layer 64 and a back side with a pressure sensitive adhesive layer 66. Alternatively, the carrier sheet may be a treated sheet such as a silicone treated paper. In the embodiment shown in FIG. 4, first carrier sheet 48 is slightly longer than label 52 and transparent sheet 58 to allow easy separation as discussed hereinafter in greater detail.

A plurality of the labels 52, transparent sheets 58 and first carrier sheets 48 are produced and laminated in a manner similar to that previously discussed in connection with the embodiment of FIG. 1 and are releasably adhered to second carrier sheet 50. Second carrier sheet 50 includes a release layer 68 on a front face thereof. In the embodiment of FIGS. 3 and 4, individual labels 52, transparent sheets 58 and first carrier sheets 48 are spaced apart on second carrier sheet 50 and separated by perforations 70. In further embodiments, label assembly 44 may be manufactured by laminating continuous sheets of the respective materials and subsequently cutting to the desired dimensions. Label 52 may include pre-printed indicia and preferably includes information face 54 with a writable or printable surface.

Label assembly 44 in preferred embodiments is used as an intermediate in producing business form 46, as shown in FIG. 5. In the embodiment shown in FIG. 5, business form 46 is an invoice although other blank forms and information sheets may be used. Business form 46 serves as an information sheet to receive variable information. Business form 46 is produced by peeling a unitary sub-assembly 74 from second carrier sheet 50 where unitary sub-assembly 74 includes label 52, transparent sheet 58 and first carrier sheet 48. Unitary sub-assembly 74 is then adhered to business form 46 in a designated information space thereon as shown in FIG. 5. Pressure sensitive adhesive 66 on first carrier sheet 48 permanently fixes sub-assembly 74 onto business form 46. As shown in FIG. 4, pressure sensitive adhesive 66 is applied to a localized area on carrier sheet 48 to define a free edge 84 on carrier sheet 48. In this manner, sub-assembly 74 is easily separated from carrier sheet 50.

Once label assembly 74 is applied to business form 46, the form can be completed in the normal course of business by inserting the necessary information onto business form 46 and to information surface 54 on label 52. Business form 46 is particularly advantageous in that it can be passed through conventional printing means including, for example, a computer-controlled laser printer. During the printing step, the necessary information is applied to complete the form and to apply variable information 76 to information surface 54 of label 52. Variable information may include an address or other labelling requirements, depending on the intended use of the business form.

In the embodiment shown in FIGS. 3–5, label 52 and transparent sheet 58 are substantially the same size and coextensive therewith. In further embodiments transparent sheet 58 may be larger than the label 52. The adhesive layers are also applied to a localized area to define a free edge 80 along transparent sheet 58 and a free edge 82 along label 52.

Figure 6:
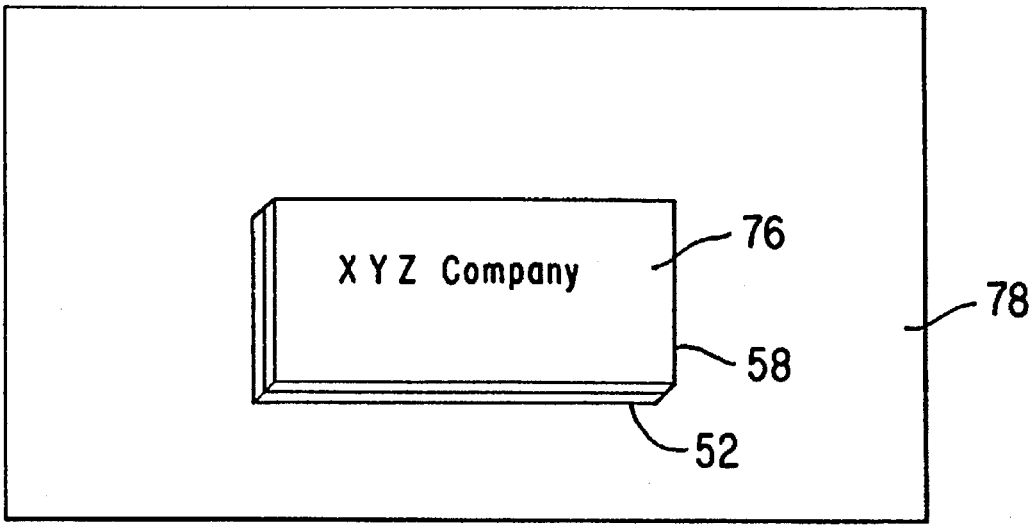
FIG. 6 is a front view of an envelope after a label and transparent sheet have been applied thereto.

In the embodiment illustrated in FIG. 5, business form 46 is printed to apply a customer's address on information face 54 of label 52 such that the label may be used as a mailing label. In this embodiment, label 52 is peeled from transparent sheet 58, as shown in FIG. 5, to expose pressure sensitive adhesive 56. Label 52, once removed from transparent sheet 56, is then applied to an envelope 78, as shown in FIG. 6. Thereafter, transparent sheet 58 is peeled from carrier sheet 48 and applied directly over label 52 on envelope 78. Transparent sheet 58 provides a protective film over label 52 to protect it from moisture, abrasion and unauthorized alteration. The first carrier sheet 48 remains adhesively attached to business form 46.

In further embodiments of the invention, the business form may be manufactured with a localized release layer. The label and transparent sheet as a unitary assembly can be adhered to the localized release layer. The resulting business form can be processed to apply the variable information to the label. The label and transparent sheet can be peeled from the form as in the previous embodiment. The embodiment may be desirable in some instances since it eliminates the need for an additional carrier sheet and the pressure sensitive adhesive and release layers associated therewith.

Although the invention has been described with a certain degree of particularity, it is understood that the present disclosure is made only byway of example and that numerous changes in the details of construction and the combination and arrangement of parts may be resorted to without departing from the spirit and scope of the invention. Thus, the scope of the invention is not limited by the foregoing specification, but rather, by the scope of the claims appended hereto.

What is claimed is:

1. A multi-layer label assembly comprising:

a label having a first information side and a second side with a pressure sensitive adhesive applied thereto;

a transparent sheet having first and second sides, said transparent sheet being superimposed with said label and having said first side of said transparent sheet releasably adhered to said second side of said label; and an adhesive on said second side of said transparent sheet for permanently bonding said transparent sheet to said first information side of said label.

2. The label assembly of claim 1, wherein said assembly comprises a release layer on said first side of said transparent sheet, and said pressure sensitive adhesive on said label being releasably adhered to said release layer.

3. The label assembly of claim 1, wherein said adhesive on said transparent sheet is a pressure sensitive adhesive.

4. The label assembly of claim 3, further comprising a first removable carrier sheet releasably adhered to said pressure sensitive adhesive on said transparent sheet.

5. The label assembly of claim 4, wherein said first carrier sheet comprises a release coating on a first side thereof.

6. The label assembly of claim 5, wherein said first carrier sheet comprises a pressure sensitive adhesive on a second side thereof.

7. The label assembly of claim 6, further comprising a second removable carrier sheet releasably adhered to said pressure sensitive adhesive on said first carrier sheet.

8. The label assembly of claim 7, wherein said second carrier sheet comprises a release coating on a first side thereof, said release coating being removably adhered to said pressure sensitive adhesive on said first carrier sheet.

9. The label assembly of claim 1, wherein said transparent sheet is larger than said label.

10. The label assembly of claim 1, wherein said information side of said label comprises a printable surface.

11. The label assembly of claim 1, wherein said label includes printed indicia.

12. The label assembly of claim 1, wherein said transparent sheet is substantially the same size as said label.

13. A multi-layer label assembly comprising a label having a front side with an information surface;

a pressure sensitive adhesive on a back side of said label;

a transparent sheet having a first side releasably adhered to said back side of said label;

a pressure sensitive adhesive on a second side of said transparent sheet; and a removable carrier sheet releasably adhered to said pressure sensitive adhesive on said transparent sheet.

14. The label assembly of claim 13, further comprising an adhesive release coating on said first side of said transparent sheet.

15. The label assembly of claim 13, wherein said carrier sheet comprises a silicone treated paper.

16. The label assembly of claim 13, wherein said label comprises printed indicia on said information surface.

17. The label assembly of claim 13, wherein said label is removable from said transparent sheet and permanently adherable to a substrate, and said transparent sheet is removable from said carrier sheet and permanently adherable on said label.

18. The label assembly of claim 17, wherein said pressure sensitive adhesives on said label and transparent sheets are in localized areas on said back side of said label and second side of said transparent sheet, respectively, whereby each said label and transparent sheet have an edge free of adhesive.

19. The label assembly of claim 13, said transparent sheet and said label being substantially the same size.

20. The label assembly of claim 13, wherein said transparent sheet is larger than said label.

21. The label assembly of claim 13, wherein said label comprises a writable portion of said information surface.

22. The label assembly of claim 13 wherein said carrier sheet is a continuous backing sheet, and said assembly comprises a plurality of said labels and transparent sheets adhered to said continuous carrier sheet.

23. A business form comprising:

an information sheet;

a transparent sheet having a pressure sensitive adhesive on a back side releasably adhering said transparent sheet to said information sheet; and a label having a front side with an information surface and a back side having a pressure sensitive adhesive, said label being releasably adhered to a front side of said transparent sheet by said pressure sensitive adhesive on said label.

24. The business form of claim 23, further comprising a carrier sheet positioned between said information sheet and said transparent sheet, wherein said carrier sheet is fixed to said information sheet, and said transparent sheet is releasably adhered to said carrier sheet.

25. The business form of claim 24, wherein said carrier sheet has a release coating on a front side thereof.

26. The business form of claim 23, wherein said label is removable from said transparent sheet and permanently adherable to a substrate, and said transparent sheet is removable from said information sheet and permanently adherable to said front side of said label.

27. The business form of claim 23, wherein said transparent sheet and said label are smaller than said information sheet and are positioned in a localized area on said information sheet.

28. The business form of claim 23, wherein said transparent sheet comprises a release layer on a front side thereof.

29. The business form of claim 23, wherein said information surface is a printable surface.

30. A method of labelling an article comprising:

providing a label assembly with a label having a front side with an information surface and a back side having a pressure sensitive adhesive, a transparent sheet having a first side releasably adhered to said back side of said label and a second side having a pressure sensitive adhesive, and a removable carrier sheet releasably adhered to said transparent sheet;

removing said label from said assembly and adhering said label to said article; and removing said transparent sheet from said carrier sheet and adhering said transparent sheet to said information surface of said label.

31. The method of claim 30, further comprising the step of applying indicia to said information surface before removing said label from said assembly.

32. The method of claim 30, wherein the step of adhering further comprises superimposing said transparent sheet over said front side of said label to completely cover said label.

* * * * *